US007736737B2

(12) United States Patent
Van Dun et al.

(10) Patent No.: US 7,736,737 B2
(45) Date of Patent: Jun. 15, 2010

(54) FIBERS FORMED FROM IMMISCIBLE POLYMER BLENDS

(75) Inventors: Jozef J. I. Van Dun, Bellaire, TX (US); Daniel R. Bosak, Bellmawr, NJ (US); John E. Flood, Cypress, TX (US); Edward N. Knickerbocker, Lake Jackson, TX (US); Thomas Allgeuer, Wollerau (CH); Karin Katzer, Horgen (CH); Miguel A. Prieto Goubert, Richterswil (CH)

(73) Assignee: Dow Global Technologies Inc., Midland, MI (US)

( * ) Notice: Subject to any disclaimer, the term of this patent is extended or adjusted under 35 U.S.C. 154(b) by 950 days.

(21) Appl. No.: 10/541,564

(22) PCT Filed: Jan. 30, 2004

(86) PCT No.: PCT/US2004/002837

§ 371 (c)(1),
(2), (4) Date: Jul. 6, 2005

(87) PCT Pub. No.: WO2004/067818

PCT Pub. Date: Aug. 12, 2004

(65) Prior Publication Data

US 2006/0234049 A1 Oct. 19, 2006

Related U.S. Application Data

(60) Provisional application No. 60/443,740, filed on Jan. 30, 2003.

(51) Int. Cl.
*D01F 8/00* (2006.01)

(52) U.S. Cl. ..... 428/373; 428/370; 428/372; 428/374; 428/397

(58) Field of Classification Search ..... None
See application file for complete search history.

(56) References Cited

U.S. PATENT DOCUMENTS

| | | | | |
|---|---|---|---|---|
| 3,485,706 | A | 12/1969 | Evans | |
| 3,498,941 | A | 3/1970 | Hofton et al. | |
| 3,998,988 | A * | 12/1976 | Shimomai et al. | 428/400 |
| 4,254,182 | A | 3/1981 | Yamaguchi et al. | |
| 4,322,027 | A | 3/1982 | Reba | |
| 4,413,110 | A | 11/1983 | Kavesh et al. | |
| 4,430,563 | A | 2/1984 | Harrington | |
| 4,663,220 | A | 5/1987 | Wisneski et al. | |
| 4,668,566 | A | 5/1987 | Braun | |
| 5,108,827 | A * | 4/1992 | Gessner | 428/219 |
| 5,272,236 | A | 12/1993 | Lai et al. | |
| 5,278,272 | A | 1/1994 | Lai | |
| 5,486,419 | A | 1/1996 | Clementini et al. | |
| 5,654,097 | A * | 8/1997 | Choe et al. | 428/373 |
| 5,773,144 | A * | 6/1998 | Choe et al. | 428/373 |
| 6,417,121 | B1 * | 7/2002 | Newkirk et al. | 442/364 |
| 6,417,122 | B1 * | 7/2002 | Newkirk et al. | 442/364 |
| 6,458,726 | B1 * | 10/2002 | Harrington et al. | 442/364 |

FOREIGN PATENT DOCUMENTS

| | | |
|---|---|---|
| FR | 2057816 | 5/1971 |
| WO | WO-01/49908 A2 | 7/2001 |

* cited by examiner

*Primary Examiner*—Jill Gray

(57) ABSTRACT

The present invention relates to soft touch fibers and non-woven fabrics made from such fibers. The fibers comprise an incompatible polymer system which leads to the soft touch quality. The fibers comprise a mixture of at least two thermoplastic polymers each having different viscosities and wherein the mixture has an interfacial tension from about 0.5 to about 20 mN/m, and wherein the mixture comprises a portion of the fiber surface. The fibers may include from 40-98 percent of a polyolefin continuous phase and from 2 to 60 weight percent of an amorphous thermoplast dispersed phase, such as polystyrene or polyamide.

10 Claims, 6 Drawing Sheets

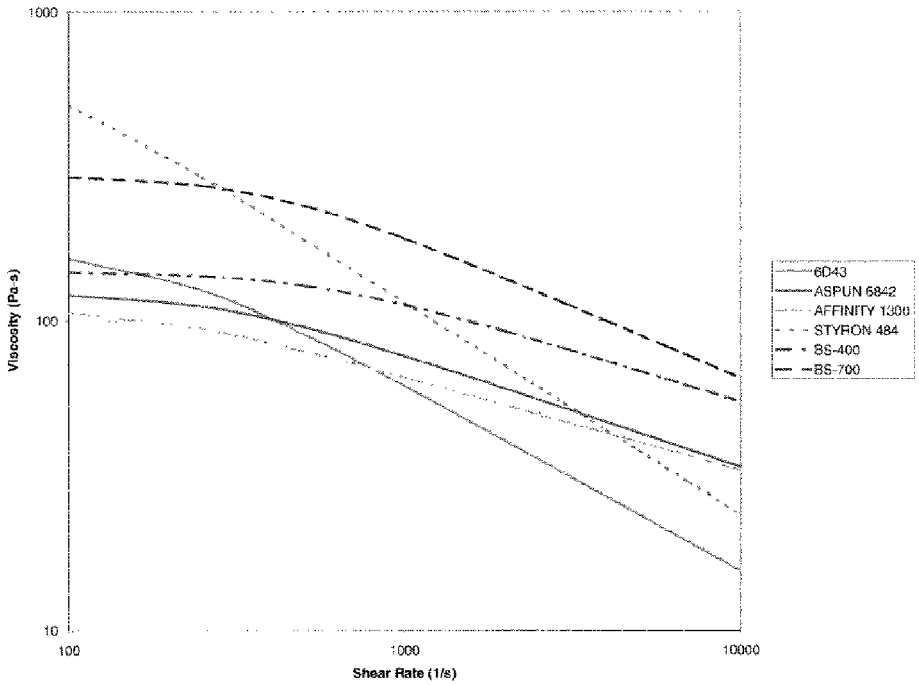
Figure 1: Viscosities of Resins used as Sheath Components at 250°C

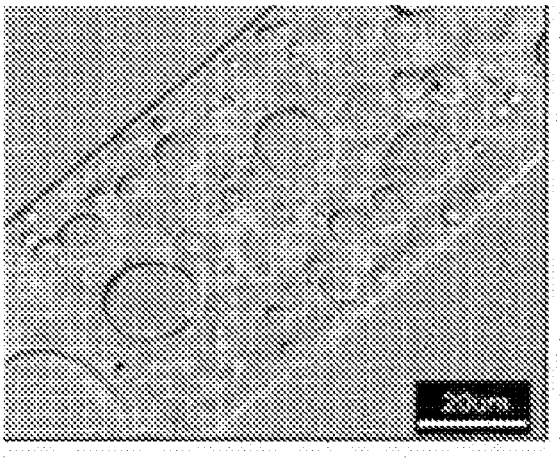
Figure 2: Microtome Image of STYRON in 6D43 at 100x
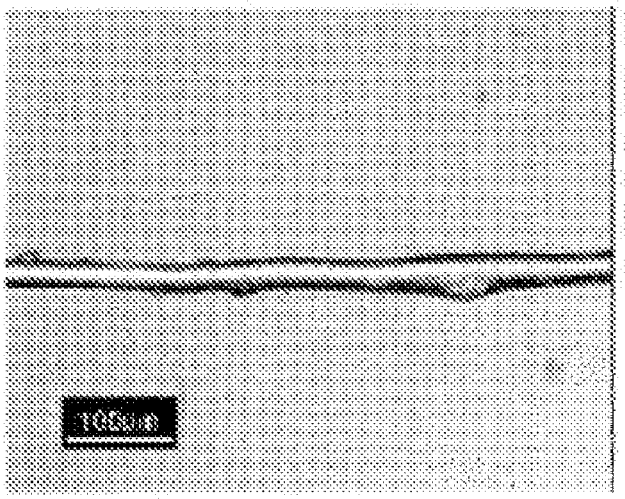
Figure 3: Original Light Microscopy Image of Fiber

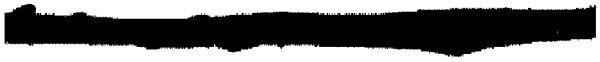
Figure 4: Binary Image of Fiber
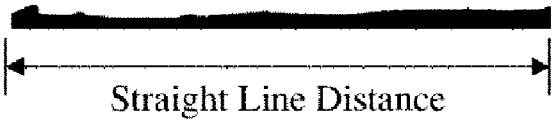
Figure 5: Example Image for Length-Difference Method
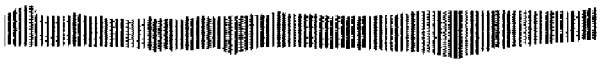
Figure 6: Lined Representation of Fiber

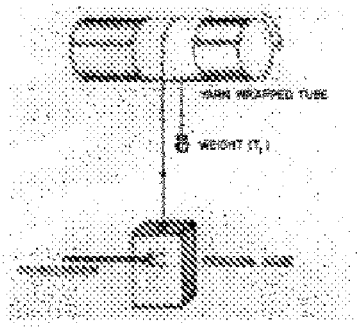
Figure 7: Capstan Yarn Friction Apparatus
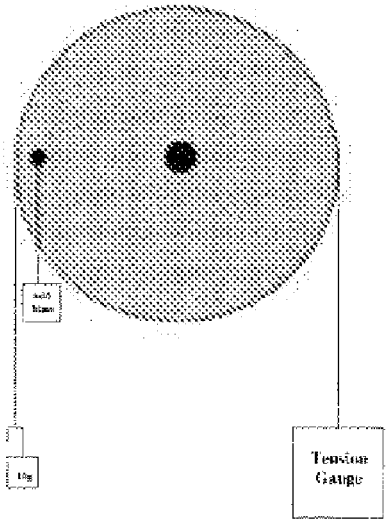
Figure 8: Static Friction Test Set-up

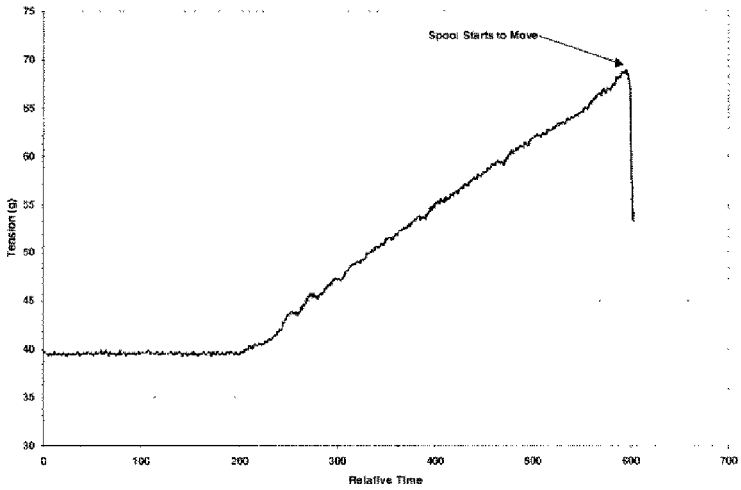
Figure 9: Increase in Yarn Tension with Addition of Mass to Spool
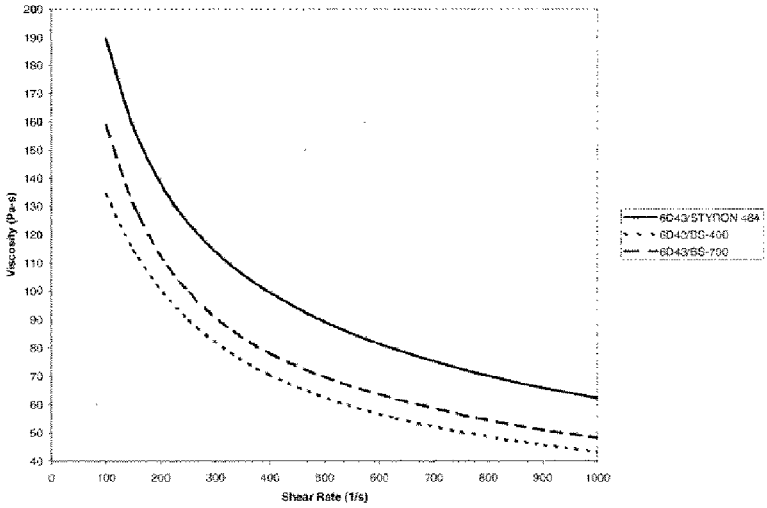
Figure 10: Viscosities of 6D43 Blends at 250°C

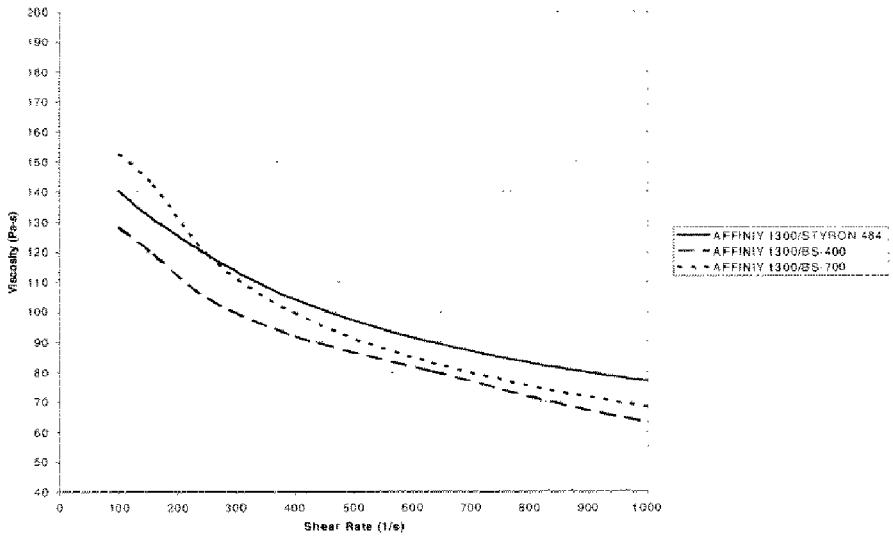
Figure 11: Viscosities of ASPUN Blends at 250°C
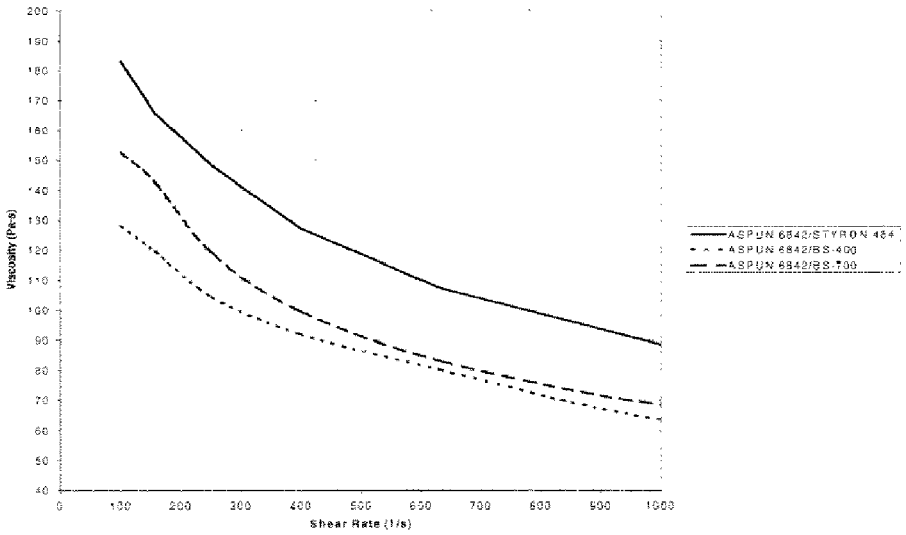
Figure 12: Viscosities of AFFINITY Blends at 250°C

FIBERS FORMED FROM IMMISCIBLE POLYMER BLENDS

This patent application claims priority from U.S. Provisional application 60/443,740, filed Jan. 30, 2003, the content of which is hereby incorporated by reference in its entirety.

BACKGROUND AND SUMMARY OF THE INVENTION

The present invention relates to soft touch fibers and nonwoven fabrics made from such fibers. The fibers comprise an incompatible polymer system which leads to the soft touch quality.

Polypropylene nonwoven fabrics are used in many medical and hygiene applications. For these purposes, the material must not only meet mechanical requirements, but must also have acceptable feel and appearance. For quite some time, there has been a desire to make polypropylene nonwovens with cloth-like aesthetics, as polypropylene nonwovens are often described as oily and plastic-like. One approach to change the tactile perception of polypropylene nonwovens is to change the surface texture of the fibers.

Incompatible blends have been used to form fibers with an irregular fiber surface. These fibers have a distinctly different feel. However, they have poor mechanical properties and are difficult to spin. It has been discovered that using these blends as the outer layer of a fiber, for example as the sheath component in a bicomponent fiber gives the desired feel while the core can provide the spinnability and mechanical properties.

The present invention involved forming fibers from a series of immiscible blends and quantifying the fiber properties of the resulting fibers. The results provide an understanding of the parameters that affect the fiber morphology, ultimately leading to controlling the fiber surface structure to obtain desired aesthetic properties.

BRIEF DESCRIPTION OF THE DRAWINGS

FIG. 1 is a plot of the viscosities of resins used in the Examples as a function of shear rate;

FIG. 2 is a microtome image showing the dispersed phase and matrix phase;

FIG. 3 is a light microscopy image of a fiber;

FIG. 4 is a binary image of the fiber of FIG. 3;

FIG. 5 is an example image for the length-difference method of quantifying surface irregularities;

FIG. 6 is a lined representation of a fiber for the height distribution method of quantifying surface irregularities;

FIG. 7 is a depiction of an apparatus suitable for determining fiber friction according to the Capstan method;

FIG. 8 is a depiction of the set up suitable for determining static fiction;

FIG. 9 is a plot showing the increase in yarn tension with the addition of mass to the spool;

FIG. 10 is a plot of viscosity vs. shear rate for various blends;

FIG. 11 is a plot of viscosity vs. shear rate for various blends; and

FIG. 12 is a plot of viscosity vs. shear rate for various blends.

DETAILED DESCRIPTION OF THE INVENTION

The factors that create or affect cloth-like aesthetics are important to understand since the ultimate goal is to produce a nonwoven with those characteristics. Understanding how immiscible blends react and interact under various conditions is important in aiding in proper material selection. Elongational flow is the final step that will impose the final fiber morphology. This will affect both mechanical properties as well as the surface texture of the fibers.

The feel of a fabric, generally referred to as hand or handle, is a very subjective impression usually associated with quality. There are numerous descriptors used to explain the feel of a fabric. Some of the most common are smoothness, softness, firmness, coarseness, thickness, weight, warmth, harshness, and stiffness. Although these terms help in understanding how a particular fabric feels, for engineering purposes it is important to be able to relate this subjective impression with objectively measurable quantities. Kawabata is generally credited with being the first to effectively relate the mechanical properties of fabrics to hand. The Kawabata Evaluation System (KES) was developed in 1972 for use with men's suiting. KES uses 16 mechanical properties to describe fabric hand, listed in Table 1.

TABLE 1

Mechanical properties required by KES to describe fabric hand

| Parameter | Description |
|---|---|
| Tensile | |
| LT | linearity of load/extension curve |
| WT | tensile energy |
| RT | tensile resilience |
| EM | extensibility, strain at 500 N/m |
| Bending | |
| Bending | bending rigidity |
| 2HB | hysteresis of bending moment |
| Shearing | |
| G | shear stiffness |
| 2HG | hysteresis of shear force at 0.5° of shear angle |
| 2HG5 | hysteresis of shear force at 5° of shear angle |
| Compression | |
| LC | linearity of compression/thickness curve |
| WC | compressional energy |
| RC | compressional resilience |
| Surface | |
| MIU | coefficient of friction |
| MMD | mean deviation of coefficient of friction (frictional roughness) |
| SMD | geometric roughness |
| Construction | |
| T | fabric thickness |
| W | fabric basis weight |

It has been shown in Barker, R. and Scheininger, M., "Predicting the Hand of Nonwoven Fabrics from Simple Laboratory Measurements" *Textile Research Journal,* 1982, that the use of KES is effective in predicting fabric hand, but also uses experiments to determine an array of heat and moisture properties of fabrics. These properties have been shown to have a pronounced effect on fabrics intended for clothing. The $Q_{max}$ value (maximum rate of heat transfer) correlates well with the perceived warm or cool touch of a fabric. Moisture testing correlates well with perceived clamminess or dampness of a fabric.

Barker also showed that only a few KES parameters are needed to predict subjective perceptions of fabric hand. For most of Barker's correlations, only 2 to 4 fabric properties are required for prediction of hand. The important fabric parameters and the correlations established from the KES evaluation are a function of the type of fabric and the end use. For example, surface roughness and thickness correlate well for the hand of single knit fabrics, while surface roughness and bending hysteresis correlate well for the hand of double knit fabrics. Both of these fabrics are used to make T-shirts however differ in important (correlated) measurable parameters.

Intrinsic properties certainly affect the aesthetics of a fabric however processing also has a pronounced effect. Unfortunately, the understanding of how processing affects properties is only qualitative, but some important relationships have been observed.

The luster and gloss of the material will be greatly affected by the morphology of the fiber and its cross section. The transparency of a fabric is almost entirely determined by the morphology of the fiber and the construction of the yarn and/or fabric. Handle is primarily determined by three cloth properties: stiffness, softness, and bulkiness (thickness per unit weight). Factors like stiffness will be affected by the intrinsic stiffness of the polymer but also (and sometimes more importantly) by the fiber processing and/or fabric construction.

The effect of yarn and/or fabric construction is at least as critical as the nature of the material. Stiffness can be determined from the flexural rigidity of the fabric, which depends on the shear modulus and coefficient of friction. Both of these properties are affected by swelling and hence humidity. Increases in the smoothness of the fiber and fabric increase the softness of a fabric. Yarns with higher bulkiness will give fabrics with better handle and drape, higher coverage, and greater comfort. Handle and drape are strongly influenced by fabric construction and post treatments of the fabric. See, for example, Van Krevelen, D. W. "Their Correlation with Chemical Structure; Their Numerical Estimation and Prediction from Additive Group Contribution" *Properties of Polymers.* 3rd Ed. Elsevier, Amsterdam, Oxford, New York, Tokyo 1990.

Previous work conducted by Yamaguchi et al. (U.S. Pat. No. 4,254,182) on polyester fibers and fabrics shows that the fiber friction correlates well with fabric hand. The static coefficient of friction should be increased while the dynamic coefficient of friction remains essentially constant for an improvement in fabric hand to be realized. Simply increasing the overall coefficient of friction does not improve fabric hand. A ratio of static to dynamic friction of at least 1.7 is required to change fabric hand significantly. Similar trends are expected for polyolefin fibers, although the actual values of the ratio will likely vary from those seen in polyester.

Bicomponent fibers are comprised of two polymers of different chemical and/or physical properties extruded from the same spinneret with both polymers within the same filament.

There are many variations of bicomponent fibers structures, the two simplest and most common are side-by-side and sheath-core structures. Numerous other complex bicomponent structures can be made to produce unique fiber properties, such as an islands-in-a-sea bicomponent fiber.

Bicomponent fiber spinning is similar to monofilament fiber spinning however is more complex due to the combination of multiple streams. The most common bicomponent spinning arrangement is to use two extruders and two melt pumps, one for each component. The two streams are then combined at the spinneret to form the desired bicomponent fiber.

Regardless of the method used to obtain the two component streams, they are each split into multiple channels and fed to the spin manifold. Bicomponent spin manifolds are specifically designed to accommodate two separate melt streams. Obviously, these manifolds are more complicated than traditional monofilament manifolds but the concept remains the same. The multiple channels of the two component streams are separated further into numerous smaller streams and combined just before or at the spinneret orifice.

The shape of the interface between the two components is altered by adjusting the shape and position of the separating elements within the spinneret. The ratio of the components can be altered by simply adjusting the speeds of the melt pumps.

Some current uses of bicomponent fibers are as binder fibers and self-crimping fibers. The binder fibers utilize a sheath-core structure with the binder material as the sheath. A PP core and a PE sheath is a common bicomponent fiber used for this purpose. Self-crimping fibers utilize side-by-side or eccentric sheath-core structures. Sheath-core structures may also be formed with an asymmetric cross section. Side-by-side configurations tend to have problems with splitting due to the internal stresses formed at the interface, so eccentric sheath-core is many times preferable. A difference in orientation across the fiber causes crimping due to non-uniform shrinkage of the fiber. Sheath-core structures are also used to realize the benefits of expensive polymers or additives but at significant cost savings. The core is comprised of a relatively inexpensive polymer while expensive components are added to the sheath.

Nonwoven is a broad term used to describe fabrics made through means other than weaving or knitting. Polypropylene is used in approximately 1 billion pounds of nonwovens per year (1994) with staple fiber showing 475,000,000 lb. and melt-spun fabrics 400,000,000 lb. Individual fibers are arranged into an unbonded collection called a web. There are three common methods for producing fiber webs: dry-laid, wet-laid, and melt-spun.

Dry-laid systems generally start with staple fibers of 0.5-1.5 inches in length and can create fabric webs with a basis weight of 1-90 ounces per square yard. Carding and air-laid are the two dry-laid processes. Carding uses a series of needle covered rollers to arrange the fibers into a web. The web has a preferential machine direction bias. Fabric orientation can be altered by stacking carded webs in alternating machine directions. Air-laid systems use jets of air to suspend fibers and add cross-direction orientation before depositing them onto a belt or screen. This process creates a somewhat isotropic web.

The wet-laid process is very similar to the process used in paper manufacturing. Short staple fibers (<10 mm) are used to create webs of 0.3-16 ounces per square yard. The fibers are mixed with chemicals and water to form a slurry. The slurry is deposited onto a moving wire screen where the excess water is removed before drying. Uniform webs are created quickly with this process. Wet-laid systems are able to produce fabrics at rates 100-1000 times faster than dry-laid but require much more energy due to the large amount of water that must be pumped through the system and removed from the fabric.

The melt-spun or polymer-laid process uses equipment exclusive to polymer extrusion. This process utilizes the continuous fibers extruded through a spinneret to create webs of 0.5-20 ounces per square yard. The extruded fibers are laid down on a moving belt forming a continuous web that is then mechanically or thermally bonded.

Bonding of a fiber web occurs through mechanical, thermal, chemical bonding, although combinations of these processes may also be used. Mechanical bonding works by entangling fibers through needle punching or spunlacing processes. These methods are most suitable for high basis-weight fabrics since the entangling varies the fiber density (throughout the web), which is noticeable with low weight fabrics.

Needle punching uses barbed needles to entangle fibers perpendicular to the web surface. Needles are set into a board that moves perpendicular to the fiber web. The needles penetrate the fiber web and then pull the fibers when removed, entangling the fiber web and forming a nonwoven. The bonding can be easily varied by changing the needle type, concentration, and/or the web speed.

Spunlacing is also commonly referred to as hydroentangling or liquid needle punching. The concept is very similar to needle punching, but water jets are used instead of needles. The web is laid on a perforated belt and passed over water jets that entangle fibers, forming the web.

Thermal bonding is used to fuse thermoplastic fibers using heat and/or pressure. Through air bonding and radiant heat source bonding use a binder fiber or powder which melts and upon cooling forms weld spots throughout the web. Ultrasonic vibrations are used to apply rapid compression forces to localized areas of the web. The compression creates heat, which softens the fibers and bonds them together. Thermal calendering uses two heated rolls to bond fibers through heat and pressure. Binder fibers may be used to improve bonding or allow bonding of fibers that do not melt. One of the rolls may be engraved, which will form a bond pattern throughout the fabric. The amount of bonding can be altered by changing temperature, pressure, and/or the engraved pattern.

Chemical bonding uses a polymer solution that is deposited in the web and thermally cured to form a bonded structure. The polymer solution may be sprayed onto the web surface, saturated into the web, or printed on the web. Spray bonding generally results in a weaker web while saturation bonding generally results in a stiffer fabric. Print bonding allows for varying degrees of bonding and is able to better control fabric properties.

One aspect of the present invention is a fiber which when used to form a nonwoven produces a nonwoven material having cloth-like aesthetics with acceptable strength while also maintaining acceptable processing characteristics. We have now discovered a bicomponent fiber comprising at least three thermoplastic polymers, wherein a mixture of at least two of the polymers have an interfacial tension from 0.5 to 20 mN/m, a viscosity ratio 1.5 up to 10, or a viscosity ratio 0.05 up to 0.1 and the mixture comprises a portion of the fiber surface. This fiber has excellent hand or feel characteristics, while maintaining good mechanical properties.

In another aspect of the invention, we have discovered fiber comprising a mixture of at least two thermoplastic polymers having an interfacial tension from 0.5 to 20 mN/m, a viscosity ratio $\geqq$1.5 up to 10, or a viscosity ratio $\leqq$0.05 up to 0.1, wherein the mixture comprises a portion of the fiber surface. Preferably this fiber comprises a bicomponent fiber, especially a sheath core bicomponent fiber. In this embodiment, it is more preferable that the mixture comprise the sheath, especially wherein the mixture comprises less than 20 percent by volume (of the entire fiber). The core can comprise a propylene polymer, such as a homopolymer propylene polymer.

In an additional embodiment of the bicomponent fiber, the mixture can comprise a matrix polymer and a dispersed polymer. The matrix polymer can has a melting point at least 10° C. or less than a melting point of the dispersed polymer, or the dispersed polymer is amorphous and has a glass transition temperature $\leqq$10° C. than the melting point of the matrix polymer. More preferably, the matrix polymer in the sheath, and the core each have viscosity within 30 percent from each other. The mixture can have a viscosity $\leqq$170 Pa·s at 100 l/s at 250° C. The dispersed polymer can in particulate form, having an average thickness larger than 1 micron. Preferably, the sheath has a thickness smaller than that of the particle.

In an additional aspect of the invention, the surface of the fiber (for example a homofilament or the sheath of a sheath-core bicomponent fiber) can comprise (a) 40 to 98 weight percent of a polyolefin continuous phase and (b) from 2 to 60 weight percent of an amorphous thermoplastic dispersed phase (such as polystyrene, polyethylene terephthalate, polycarbonate; polyamide; styrene copolymers such as accrylonitrile-butadiene-styrene copolymer; and/or thermoplastic polyurethanes) and (c) from 0 to about 20 weight percent of a compatibilizer, wherein the ratio of the melt flow rate of the dispersed phase to the melt index of the polyolefin is less than 2.

In another aspect, we have discovered a fiber comprising a mixture of at least two thermoplastic polymers wherein the mixture comprises a dispersed polymer and a matrix polymer, wherein the dispersed polymer exists in particulate form having a size larger than 1 micron and comprises a portion of the fiber surface.

Preferably, the dispersed particulate forms irregularities on the fiber surface.

By "matrix" is meant the continuous phase of the mixture, as evidenced by optical microscopy. By "dispersed" is meant the discontinuous phase of the mixture, also as indicated by optical microscopy.

The fiber can have may shapes, including but not limited to for example, sheath/core, side-by-side, crescent moon, trilobal, flat (ribbon-like), round.

Fabricated articles made from the mixtures may be processed using all of the conventional polyolefin processing techniques. Useful articles, in general, include films (for example, cast, blown and extrusion coated), fibers (for example, staple fibers (including use of the mixture disclosed herein as at least a portion of the fiber's surface), spunbond fibers or melt blown fibers (for example, using systems disclosed in U.S. Pat. No. 4,430,563, U.S. Pat. No. 4,663,220, U.S. Pat. No. 4,668,566 or U.S. Pat. No. 4,322,027, and gel spun fibers (for example, that disclosed in U.S. Pat. No. 4,413,110) both woven and non-woven fabrics (for example, spunlaced systems disclosed in U.S. Pat. No. 3,485,706) or structures made from such fibers (including blends of these fibers with other natural or synthetic fibers) and molded articles (for example, injection molded, blow molded or roto-molded articles). The mixtures are also useful in wire and cable coating applications, as well as sheet extrusion for vacuum forming operations.

Examples

The materials for the matrix and the dispersed phases of the incompatible blends are selected to cover a range of blend properties. 5D49 Polypropylene (PP), produced by Dow Chemical, is used in these examples as the core material since it is a standard PP material used in nonwovens, is easily spinnable, and has good mechanical properties. Fibers made of pure are the controls for the experiment.

Polyethylene (PE) and Polypropylene resins are used as the matrix materials in these examples since they are compatible with the core material (that is low interfacial tension between the sheath and core). Two PE resins are being used differing in density (crystallinity), which may have an effect on the blend morphology. Polystyrene (PS) and Polyamide-6 (PA6) are being used because they are immiscible with both PE and PP. The resins and their general specifications are listed in Table 2.

TABLE 2

| Material Specifications | | | |
|---|---|---|---|
| 6D43[1] | PP-RCP | 0.90 | 35/230° C. |
| ASPUN 6842[1] | PE | 0.955 | 29/190° C. |
| AFFINITY 1300[1] | PE | 0.90 | 30/190° C. |
| STYRON 484[1] | PS | 1.04 | 2.8/200° C. |
| BS-400[2] | PA-6 | 1.14 | 2.4 RV[3]/290° C. |
| BS-700[2] | PA-6 | 1.14 | 2.7 RV[3]/290° C. |

[1]Produced by Dow Chemical
[2]Produced by BASF
[3]Reative (solution) Viscosity

MFR is melt flow rate (grams/10 minutes) and is tested using ASTM D1238, 2.16 kg weight at the temperature indicated. Density is measured in accordance with ASTM D 792. PP-homo 5D49 is a homopolymer polypropylene. PP-RCP 6D43 is a random copolymer of polypropylene and uses ethylene as a comonomer. ASPUN 6842 is an ethylene/1-octene copolymer made using a Ziegler type of catalyst. AFFINITY 1300 is an ethylene/1-octene copolymer made using constrained geometry catalyst technology in accordance with U.S. Pat. No. 5,272,236 and U.S. Pat. No. 5,278,272. STYRON 484 is high impact polystyrene. The bicomponent filament in this disclosure can use a core of a conventional, Ziegler-Natta catalyzed, visbroken polypropylene homopolymer of 38 MFR, such as that disclosed in U.S. Pat. No. 5,486,419 (see col. 8, line 16 for example).

Since the resins, especially polyethylene and polypropylene, are intended for extrusion and fiber spinning, it requires stabilization, as is well-known in the art, to preserve its molecular weight and molecular weight distribution during exposure to heat and oxygen. Such stabilization comprise compounds necessary for catalyst acid neutralization and thermal stabilization. The latter compounds, in the class of antioxidants and phosphites, serve to neutralize the oxygen and peroxy radicals formed in hot polymer melts in the presence of oxygen.

Suitable acid acceptors can include (not necessarily exclusively) compounds such as metal stearates (for example, stearates of Ca, Zn, or Mg), metal oxides (for example, ZnO), and natural and synthetic hydrotalcites. Typical levels are 100-1500 ppm wt., preferably less than 1000 ppm, and most preferably 200-500 ppm.

Stabilization against oxidative degradation most often uses compounds of the class of antioxidants (for example, phenolics such as tetrakismethylene(3,5-di-tert-butyl-4-hydroxyhydrocinnamate)methane (CAS #6683-19-8), or octadecyl3,5-di-tert-butyl-4-hydroxyhydrocinnamate (CAS #2082-79-3), or tris(3,5-di-tert-butyl-4-hydroxybenzyl) isocyanurate (CAS #27676-62-6), or 3,3',3',5',5'-hexa-tert-butyl-a,a',a'-(mesitylene-2,4,6-triyl)tri-p-cresol (CAS #1709-70-2)) and process stablizers (for example, phosphites such as tris(2,4-di-tert-butylphenyl) phosphite (31570-04-4), or bis(2,4-di-t-butylphenyl)pentaerythritol diphosphite (CAS #26741-53-7), or tetrakis(2,4-di-tert-butyl-phenyl)4,4'-biphenylene-diphosphonite (CAS #38613-77-3)). Such compounds (phenolics and phosphites) can be used singly or in combination. In combination, the concentration of the individual phenolic or phosphite compounds are each typically in the range of 250-1500 ppm wt., preferably less than 1500 ppm, most preferably 500-1000 ppm. The use of PS and PA-6 allows for differences in viscosity ratios as well as differences in interfacial tensions to be explored. The use of two PA6 resins allows for different viscosity ratios with the same interfacial tension. The viscosities of each resin from 100-1000 l/s at 250° C. are shown in FIG. 1. The interfacial tension of each blend at 250° C. is shown in Table 3.

TABLE 3

| Interfacial Tensions of Sheath Blends at 250° C. | | |
|---|---|---|
| Sheath Blend | | Interfacial Tension |
| Matrix | Dispersed | (N/m) |
| 6D43 | STYRON 484 | 0.0045 |
| 6D43 | BS-400 | 0.0159 |
| 6D43 | BS-700 | 0.0159 |
| ASPUN 6842A | STYRON 484 | 0.0044 |
| ASPUN 6842A | BS-400 | 0.0107 |
| ASPUN 6842A | BS-700 | 0.0107 |
| AFFINITY 1300 | STYRON 484 | 0.0044 |
| AFFINITY 1301 | BS-400 | 0.0107 |
| AFFINITY 1302 | BS-700 | 0.0107 |

All blends are first dry blended using a tumble blender operated for 30 minutes. The six PA6-based blends are dried in a Novatec dryer at 90° C. for at least 24 hours before melt blending. The dryer has an air flowrate of 25 dm and maintains a dew point of −40° C. for the duration of the drying. The blends are removed from the dryer and placed directly in the extruder hopper.

Melt blending is achieved using a ZSK 30 mm co-rotating twin screw extruder with an L/D of 32. The hopper uses a vibratory feeder to feed resin into the extruder. To maintain low moisture content, three nitrogen purges are used: in the hopper, in the mouth of the extruder, and in the barrel of the extruder at the second heating zone.

Since the polymers used to make these blends are immiscible, a high intensity screw design is used to allow for a high degree of mixing. The outlet temperature was 250° C. for all blends but the temperature profile was changed for the PA6 resins. The nylon resins do not process well at the conditions used for the PS blends. Therefore, the temperature profile is increased to allow for easier processing of the PA6 blends. The speed of the extruder is also lowered to allow for more time for melting. The shear rate in the extruder is expected to be approximately the same order of magnitude as the screw rpm. Therefore, changes in screw speed are not expected to have a large effect on blend morphology.

Upon exiting the die, the blends enter a water bath and are air dried and chipped into pellet form. Some nylon blends do not fully chip and formed stands of pellets due to the short water bath and elevated temperatures. These blends are tumbled to break apart the strands and further separated by hand. All PA6 blends are then dried in the Novatec drier under the same conditions used before blending and sealed under nitrogen.

All blends contain 30 percent (v/v) dispersed phase (PS or nylon) in a PE or PP matrix. This is unlikely the optimal level of dispersed phase but will be a level at which the effects will be noticeable. This level of dispersed phase is also low enough that the region of possible phase inversion (generally 40-60 percent) will be avoided.

Fiber Spinning

All fiber spinning is conducted on a Hills bicomponent fiber line. The line contains two 1-inch extruders connected to 2.4 cc/rev melt pumps. A Hill's sheath and core bicomponent spin-pack with 144, 0.35-0.65 mm round holes having 3.4:1-4:1 L/D, with side A as the sheath and side B as the core is used for all fiber spinning. The estimated diameter is obtained through melt drawing, with no further mechanical drawing. Upon leaving the die, chilled quench air (14+/−2° C.) is used to solidify the molten fibers. The fibers are then drawn over two ceramic-coated cold rolls before being taken up by the winder. Both cold rolls and the winder operate at the same speed so that no cold drawing occurs.

The effect of draw rate is investigated by taking samples at various spinning speeds. For all samples, undrawn fibers are collected. For those samples that are spinnable, samples are collected at up to three additional conditions: 500 mpm (the lowest setting on the winder), at the speed required to produce a 4-denier fibers (1000 mpm for 20 percent sheath and 900 mpm for 12.5 percent sheath), and at the fastest possible speed without breaking. If breaks occur repeatedly at a given spinning condition, the blend is considered unspinnable at that speed and higher speeds are not tested.

5D49 PP resin is the core material for all blends. A blue PP dye is added at approximately 1-2 percent (v/v) to the core so that it is easier to view the sheath and core structure under light microscopy. The dye is added by hand and dry blended with the 5D49 prior to being placed in the hopper. Undrawn fibers are cut and the cross section viewed under light microscopy to ensure that the fibers produced contain the desired sheath/core structure.

Special care is taken to ensure that the PA6 blends are not exposed to moisture. Only one bag at a time is opened and is poured directly into the hopper containing a nitrogen purge. Once a blend is removed from the hopper, it is re-dried (under the same conditions used to initially dry the blends) before being reused.

For all samples, both extruders were operated at a constant outlet pressure of 750 psi. This is the inlet pressure to the melt pump. The temperature profile in both extruders is 189, 225, 235, 250° C. from zone one to four respectively, with the spin head also maintained at 250° C. The melt temperature ranges from 241 to 244° C. for all samples.

To observe the effect of the sheath to core ratio, two sheath to core ratios are considered. The sheath to core ratio is varied by changing the speed of the melt pumps. The core is pumped at a constant 67.2 g/min (28 rpm) and the sheath is pumped at both 16.8 g/min (7 rpm) and 9.6 g/min (4 rpm) for each blend. The former sheath flowrate produces a fiber with 20 percent sheath (by volume) while the later produces a fiber with 12.5 percent sheath. This will also increase the overall thickness of the fibers at a given spinning speed.

Characterization

Rheology

Rheology data is obtained for all pure resins and blends using parallel plate and capillary rheometers. The parallel plate rheometer is a Rheometrics RMS-800 (serial number 021-043). The capillary rheometer is a Göttfert Rheograph 2003. Only the parallel plate rheometer is equipped with a nitrogen purge. The parallel plate rheometer gives data from 0.1-100 rad/s and the capillary rheometer gives data from 100-10,000 l/s.

For the parallel plate samples, a 25 mm diameter, 2 mm thick plaque is made. This is done by first using a hydraulic press to create a 2 mm thick square plaque. The press operates at a temperature of 405° F. for the PE, PP and PS samples and 450° F. for the PA-6 samples, and a dwell time of 5 minutes. Once removed, a punch is used to make the mm diameter disk used in the rheometer.

Special care is given to PA-6 containing samples. All PA-6 samples are dried at 90° C. in a vacuum oven under nitrogen for at least 48 hours, prior to testing. The nylon is removed from the vacuum oven just prior to making the plaque and placed in the rheometer as soon as possible. Both the hydraulic press and the rheometer operate under nitrogen purge.

The parallel plate rheometer uses 25 mm plates and operates at a temperature of 250° C. The plates compress the 2 mm plaque to 1.5 mm (or less) and the resin on the edge of the plates is removed. An eight-minute equilibration period is used before the first data point is taken. The transducer used has a range of 0.2-200 g.cm. The strain rate is adjusted to obtain a torque value greater than 0.2 g.cm for the first data point. A frequency sweep from 0.1-100 rad/s is then used for each sample. The highest shear rate(s) may yield torque values higher than 200 g.cm and therefore are omitted, since they are outside the transducer range.

The capillary rheometer also operates at 250° C. but does not have a nitrogen purge. However, the nylon containing samples are dried under the same conditions used for parallel plate prior to testing.

The unit is heated to the operating temperature for at least 1 hour prior to calibration. A die with a 12 mm diameter and 20:1 L/D is used. A 200 bar pressure transducer is used (since the melt flow rates of all components are sufficiently high). The polymer is allowed to melt for 4 minutes prior to starting the test. A frequency sweep from 100-10,000 l/s is used for each sample.

Fiber Spinning

Based on prior bicomponent work on this line, the freeze point is expected to be approximately 100 cm below the die for all drawn fibers. This corresponds to extensional rates on the order of 10 $s^{-1}$ for all fibers.

Table 4 shows the samples collected for the 20 percent sheath and 12.5 percent sheath. It is quite evident that a lower sheath volume leads to better spinnability. 6D43 blends have higher viscosities than either PE matrix material for a given dispersed phase, which is likely why the 6D43 blends are the least spinnable. STYRON blends have the highest viscosity for any given matrix material, which causes the fibers to be the least spinnable (for any given matrix material). The BS-400 blends have the lowest viscosity for a given matrix material which causes them to be the most spinnable.

TABLE 4

Summary of Fiber Samples Obtained

| Blend | | | Sheath | Fibers Obtained | | | |
|---|---|---|---|---|---|---|---|
| # | Matrix | Dispersed | (%) | undrawn | 500 mpm | 4 dpf | fastest |
| 1 | 6D43 | Styron 484 | 20 | X | no spin | no spin | n/a |
| 2 | 6D43 | BS-400 | 20 | X | X | no spin | n/a |
| 3 | 6D43 | BS-700 | 20 | X | X | no spin | n/a |
| 4 | ASPUN 6842A | Styron 484 | 20 | X | no spin | no spin | n/a |
| 5 | ASPUN 6842A | BS-400 | 20 | X | X | X | 1500 |

TABLE 4-continued

Summary of Fiber Samples Obtained

| Blend | | | Sheath | Fibers Obtained | | | |
|---|---|---|---|---|---|---|---|
| # | Matrix | Dispersed | (%) | undrawn | 500 mpm | 4 dpf | fastest |
| 6 | ASPUN 6842A | BS-700 | 20 | X | X | no spin | n/a |
| 7 | Affinity 1300 | Styron 484 | 20 | X | X | X | n/a |
| 8 | Affinity 1300 | BS-400 | 20 | X | X | X | 1500 mpm |
| 9 | Affinity 1300 | BS-700 | 20 | X | X | X | n/a |
| Control | 5D49 | 5D49 | 20 | X | X | X | 1500 & 2000 mpm |
| 1 | 6D43 | Styron 484 | 12.5 | X | no spin | no spin | n/a |
| 2 | 6D43 | BS-400 | 12.5 | X | X | X | 1500 mpm |
| 3 | 6D43 | BS-700 | 12.5 | X | X | no spin | n/a |
| 4 | ASPUN 6842A | Styron 484 | 12.5 | X | X | X | n/a |
| 5 | ASPUN 6842A | BS-400 | 12.5 | X | X | X | 1500 & 2000 mpm |
| 6 | ASPUN 6842A | BS-700 | 12.5 | X | X | no spin | n/a |
| 7 | Affinity 1300 | Styron 484 | 12.5 | X | X | X | n/a |
| 8 | Affinity 1300 | BS-400 | 12.5 | X | X | X | 2000 mpm |
| 9 | Affinity 1300 | BS-700 | 12.5 | X | X | X | 1500 mpm |
| Control | 5D49 | 5D49 | 12.5 | X | X | X | 1500 & 2000 mpm |

All samples are labeled and referenced based on blend number, sheath ratio, and spinning speed. The blend number is number shown in Table 4, with control fibers listed as "Cnt". The sheath ratio is listed by the rpm of the melt pump (for example 4 for 12.5 percent sheath and 7 for 20 percent sheath). The spinning speed is listed in m/min with "un" representing undrawn fibers. The samples are listed as "Blend number-rpm-spinning speed". Therefore, B8-4-500 is a fiber comprised of AFFINITY/BS-400 with 12.5 percent sheath, drawn at 500 m/min.

Microscopy

Microscopy is used to analyze the size of the dispersed phase in the original blends as well as the fibers formed from them. To view the initial blends, optical microscopy pictures are generated of each of the 9 blends. Plaques of each blend are made by heating a small amount (approximately 2 grams) of sample to 250° C., compressing it between two pieces of aluminum for 15 seconds at 10,000 psi, and cooling it back to room temperature.

3.5 μm thick sections are taken from the edge of each plaque using a diamond knife in an UltraCut E microtome operated at −120° C. The width of the section is equal to the thickness of the original plaque and varies slightly between samples. The sections are transferred to a glass microscope slide containing a drop of immersion oil. The sample remains uncovered for 15 minutes to allow any moisture to escape. A cover slip is applied and the image is viewed with an optical microscope to determine if any water droplets are present. Images are collected using an Olympus Vannox S compound light microscope using both 40× and 100× objectives and a Nikon DXM digital camera. An example of the image generated is shown in FIG. 2.

Imaging software cannot accurately differentiate between the dispersed phase and the matrix materials since there is not enough contrast between the two phases. However, the phase boundaries are easily distinguishable with the human eye. Therefore, the images were printed and a thin, black marker is used to outline each of the dispersed domains. This new image is scanned and opened in Adobe Photoshop 5.0. The image is converted to a binary image and the sizes of the dispersed phases are calculated using Leica Qwin imaging software. The software measures the length of each domain and calculates a roundness factor, from which the equivalent diameter is determined.

To laterally view the fibers, SEM and optical microscopy techniques are used. To generate SEM images, each sample is mounted on an aluminum sample stub covered with carbon tape. Carbon paint is used to further adhere the ends of the fiber to the tape. Mounted samples are coated with 200 Å of chromium using a Denton Vacuum DV-502A chromium sputter coater. The coater is initially evacuated to less than $5\times10^{-7}$ torr and then $5\times10^{-3}$ torr of Argon gas is introduced. A current of 4 mA is applied to produce a plasma. A chromium target is used to sputter the stationary sample to 100 Å, the sample is then rotated at approximately 25 rpm and an additional 100 Å is applied. An oscillating quartz crystal is used to determine the thickness of the sputtered coating.

A Hitachi S-4100 field emission scanning electron microscope with 4 pi digital image acquisition system, NIH image software, 5 kV accelerating voltage, and working distances between 8 and 12 mm is used to generate the SEM images. Images are generated at 50×, 100×, 250×, 500×, and 1100× for all samples and are saved in tif format. Higher magnification images (up to 7000×) may also be generated to look at specific surface features of an individual sample.

SEM images allow for much better clarity and give a more visually appealing image than optical microscopy. However, imaging software has difficulty differentiating between the dark image and the dark background. Hence, the image is not readily useable with currently available imaging software. In addition, since the entire image is in focus, it is difficult to accurately determine heights since objects further away will appear smaller. These images are also more time and cost intensive to generate than optical microscopy images (minutes versus hours). These images are useful in providing insight into surface properties of the fibers and confirming data obtained through other methods however no quantitative analysis is conducted.

To allow for a qualitative assessment of the fibers, individual fibers are placed on a glass microscope slide and held in place with double stick tape at each end. The fibers are viewed under optical microscopy using the same microscope and digital camera as used for initial blends, but with a 20× objective to allow for a length of approximately 600 um. The image is rotated so that it is horizontal and converted into a binary (black and white) image using Adobe Photoshop 5.0 so that imaging software is able to differentiate between the fiber and the background. The picture is manually rotated against a grid, until it is viewed to be horizontal.

The binary image is created by manually adjusting the threshold limit. Noticeable surface irregularities in the grayscale picture are viewed and the threshold is adjusted until the irregularities are contained in black while keeping the background white. The center of the fiber is filled so that the entire fiber is black on a white background. Examples of the original and binary images are shown in FIG. 3 and FIG. 4, respectively.

The surface irregularities are quantified via two methods using optical microscopy. Although these methods are valid, the use of optical microscopy limits the degree of accuracy. Minor differences (that is on the order of a micron) between samples will not be noticeable, but large differences will be easily discernable. Hence, these methods are intended for relative comparisons and to support the results of other methods. The first method, the length-difference method, gives the straight-line length of the sample, the actual length of the fiber surface and the number of peaks. This provides a relative measure of the irregularity of the fiber surface. The second method, the height distribution method, gives the height distribution of the fiber surface and the maximum height of each irregularity. Each method uses five replicates for each sample.

The length-difference method cuts the binary image into top and bottom sections. Leica QWin software is used to measure the straight-line length of each binary image and the surface length of each image. If the surface is perfectly smooth, the surface length is equal to the straight-line length. A large difference between the surface length and straight-line length indicates large or numerous surface irregularities. FIG. 5 shows an example where there is a significant difference between the surface length and the straight-line length.

The data is copied into excel and the difference between the curved length and straight-line length is calculated per hundred microns of straight distance. Since the length difference does not account for the number of surface irregularities (that is many small bumps will have the same result as a few large bumps), QWin also counts the number of peaks (referred to as tops) on the image surface. QWin can only measure the peaks on the top of the image surface so the bottom image is rotated 180° to allow for the peaks to be counted. The number of tops is used to normalize the difference in height. This is a relatively quick and easy test and allows for qualitative comparison of various fibers but does not give a quantitative value for the size of the peaks.

The height distribution method is used to determine the size of the peaks on the fiber surface. The height of each peak plus the sheath thickness is expected to be equal to the diameter of the dispersed phase. This is assuming that the dispersed phase is contained only in the sheath (that is does not penetrate into the core) and that the dispersed region is spherical. Photoshop is used to convert the binary image used in method one into a series of vertical lines spaced 2 pixels apart. This yields a representation of the fiber image of approximately 475 lines, FIG. 6. The lined image is cut approximately in half yielding two (top and bottom) lined images. The lines of each image are measured and recorded.

From this data, a height distribution of the fiber surface above the minimum can be generated. For many samples, this information is misleading since the base fiber diameter is not constant. With some samples, the diameter may change by a factor of 5 over a 500 um length. This is believed to be due to the sheath material coalescing in various sections along the fiber length. Therefore, a moving surface height is needed for each section of fiber. The moving surface height is calculated by finding the relative fiber minimum and maximum along the fiber surface.

To determine relative minima and maxima, if-then statements are used in excel to determine the height of a feature relative to its surrounding heights. If the height at a point is higher than both the surrounding points, it is considered a local maxima. If the point is less than the subsequent point and equal to or less than the preceding point, it is considered a local minima. This allows level fiber surfaces to be counted as minimas since the preceding points of the local minima would be equal to the minima in that case. The size of the irregularity is determined by subtracting the local maxima from the average of the nearest previous and preceding minimas.

Fiber Friction

Fiber friction is evaluated at static and dynamic conditions using a test method similar to the Capstan method described in ASTM D3412. The standard calls for a rotating yarn covered cylinder with a stationary yarn with constant tension, $T_1$, on one end and a measure tension on the opposite end, as shown in FIG. 7.

The yarn spool is used in place of the yarn-covered cylinder. A section of yarn is draped over the spool and a 10 g mass is attached to the one end; the opposite end is attached to a tension gauge. A 225 mL, container is attached to the cylinder at 90° on the side of the hanging mass. Increasing mass, in the form of PP pellets, is added to the container to induce movement. The container can hold approximately 100 g of pellets. If additional mass is required, a 100 g mass is added to the container initially before polymer is added. Mass is slowly added until the spool begins to move. A schematic of this set-up is shown in FIG. 8. The tension on the opposite end of the yarn is recorded at a scan rate of 1000 per second averaging every 100 readings for an effective (smoothed) rate of 10 per second.

The maximum tension obtained (the tension just before the yarn starts to slide) is used to calculate the static coefficient of friction using equation (1). Since the spools are of slightly different size, the wrap angle varies slightly between samples as well as the length of fiber contact. Equation (1) accounts for the differences in wrap angle but not contact length. Therefore, coefficient of friction values are normalized to a contact length of 25 cm.

$$\mu = \frac{\ln\left(\frac{T_2}{T_1}\right)}{\theta}, \text{ where} \tag{1}$$

$T_1$=applied input tension (10 g)
$T_2$=maximum tension measured
$\theta$=wrap angle in radians between $T_1$ and $T_2$ Tensile Testing Fiber samples are tested for tensile strength and elongation to determine the effects of the immiscible blend on mechanical properties. Various sheath compositions as well as spinning speeds are tested. It is hypothesized that the sheath will have no appreciable strength. Hence the tensile properties of the fibers will be a function of the core alone. It is expected that the fibers with 12.5 percent and 20 percent sheath will have 87.5 percent and 80 percent of the strength and elongation properties of the control material. Table 5 shows a summary of the fibers submitted for tensile testing.

TABLE 5

Tensile Testing Fiber Samples

| Sheath Compostion (Matrix/Dispersed) | Sheath Volume (%) | Spinning Speed (m/min) | Estimated Denier (g/9000 m) |
|---|---|---|---|
| ASPUN/STYRON | 12.5 | 500 | 7.2 |
| ASPUN/STYRON | 12.5 | 900 | 4.0 |
| ASPUN/BS-400 | 12.5 | 900 | 4.0 |
| ASPUN/BS-400 | 20 | 1000 | 4.0 |
| AFFINITY/STYRON | 12.5 | 500 | 7.2 |
| AFFINITY/STYRON | 12.5 | 900 | 4.0 |
| AFFINITY/STYRON | 20 | 500 | 7.9 |
| AFFINITY/STYRON | 20 | 1000 | 4.0 |
| 5D49 Control | 12.5 | 500 | 7.2 |

TABLE 5-continued

Tensile Testing Fiber Samples

| Sheath Compostion (Matrix/Dispersed) | Sheath Volume (%) | Spinning Speed (m/min) | Estimated Denier (g/9000 m) |
|---|---|---|---|
| 5D49 Control | 12.5 | 900 | 4.0 |
| 5D49 Control | 20 | 500 | 7.9 |
| 5D49 Control | 20 | 1000 | 4.0 |

Four to six replicates of each fiber sample are tested following ASTM D-882 is using an Instron 4501 tensile tester having a gauge length of 4 inches and a rate of 20 inches/minute.

Rheology

TABLE 6

Dispersed Particle Size in Plaques

| Blend | | Particle Diameter | | | |
|---|---|---|---|---|---|
| | | | Standard | | |
| Matrix Phase | Dispersed Phase | Average (μm) | Error (μm) | Minimum (μm) | Maximum (μm) |
| 6D43 | STYRON | 5.07 | 0.347 | 1.03 | 33.43 |
| 6D43 | BS-400 | 16.94 | 2.700 | 1.01 | 58.80 |
| 6D43 | BS-700 | — | — | — | — |
| ASPUN | STYRON | 8.00 | 0.733 | 47.52 | 0.90 |
| ASPUN | BS-400 | 9.41 | 0.450 | 22.11 | 28.00 |
| ASPUN | BS-700 | 9.75 | 1.091 | 41.50 | 1.19 |
| AFFINITY | STYRON | — | — | — | — |
| AFFINITY | BS-400 | 10.33 | 1.451 | 0.91 | 32.84 |
| AFFINITY | BS-700 | 12.43 | 1.636 | 48.13 | 1.11 |

Fiber Friction

TABLE 7

Static Coefficient of Friction Data

| Sample | Matrix Material | Dispersed Material | Normalized Static COF | Standard Error |
|---|---|---|---|---|
| Pure ASPUN | ASPUN | n/a | 0.72 | 0.011 |
| Pure AFFINITY | AFFINITY | n/a | 1.10 | 0.007 |
| Cnt-4-500 | 5D49 | n/a | 0.74 | 0.005 |
| Cnt-4-900 | 5D49 | n/a | 0.86 | 0.007 |
| Cnt-4-1500 | 5D49 | n/a | 0.80 | 0.015 |
| Cnt-7-500a | 5D49 | n/a | 0.67 | 0.009 |
| Cnt-7-500b | 5D49 | n/a | 0.70 | 0.014 |
| B2-7-500 | 6D43 | BS-400 | 0.62 | 0.005 |
| B4-4-500 | ASPUN | STYRON | 0.53 | 0.005 |
| B4-4-900 | ASPUN | STYRON | 0.63 | 0.007 |
| B5-4-500 | ASPUN | BS-400 | 0.93 | 0.012 |
| B5-4-900 | ASPUN | BS-400 | 1.05 | 0.005 |
| B5-4-1500 | ASPUN | BS-400 | 0.91 | 0.007 |
| B5-7-500 | ASPUN | BS-400 | 0.93 | 0.012 |
| B5-7-1000 | ASPUN | BS-400 | 0.93 | 0.006 |
| B6-4-500 | ASPUN | BS-700 | 0.46 | 0.005 |
| B6-7-500 | ASPUN | BS-700 | 0.54 | 0.007 |
| B7-4-500 | AFFINITY | STYRON | 0.95 | 0.010 |
| B7-7-500 | AFFINITY | STYRON | 0.92 | 0.011 |
| B7-7-1000 | AFFINITY | STYRON | 1.03 | 0.013 |
| B8-4-500 | AFFINITY | BS-400 | 0.77 | 0.007 |
| B8-4-900 | AFFINITY | BS-400 | 0.81 | 0.009 |
| B8-7-500 | AFFINITY | BS-400 | 0.91 | 0.007 |
| B8-7-1000 | AFFINITY | BS-400 | 0.80 | 0.014 |
| B9-4-500 | AFFINITY | BS-700 | 0.96 | 0.009 |
| B9-4-900 | AFFINITY | BS-700 | 1.14 | 0.008 |
| B9-7-500 | AFFINITY | BS-700 | 0.99 | 0.007 |
| B9-7-1000 | AFFINITY | BS-700 | 1.31 | 0.013 |

Tensile Data

TABLE 8

Tensile Strength and Percent Elongation of Bicomponent Fibers

| Sample | Percent Sheath | Approx Denier (g/900 m) | Peak Load (g) | Tenactiy (g/den) | Std Error Peak Load | Elongation to Break (%) | Std Error Elongation |
|---|---|---|---|---|---|---|---|
| Cnt-4-500 | 0 | 7.2 | 15.17 | 2.11 | 0.22 | 305.19 | 15.18 |
| B4-4-500 | 12.5 | 7.2 | 7.29 | 1.01 | 0.55 | 144.34 | 3.08 |
| B7-4-500 | 12.5 | 7.2 | 6.95 | 0.96 | 0.45 | 107.91 | 7.87 |
| B8-4-500 | 12.5 | 7.2 | 11.91 | 1.65 | 0.54 | 474.45 | 17.72 |
| Cnt-7-500 | 0 | 7.9 | 17.47 | 2.21 | 0.42 | 382.60 | 15.10 |
| B7-7-500 | 20 | 7.9 | 7.18 | 0.91 | 0.37 | 109.60 | 16.96 |
| B8-7-500 | 20 | 7.9 | 11.82 | 1.50 | 0.54 | 464.70 | 23.91 |
| Cnt-4-900 | 0 | 4.0 | 12.32 | 3.08 | 0.48 | 202.21 | 7.59 |
| B4-4-900 | 12.5 | 4.0 | 8.52 | 2.13 | 0.80 | 133.26 | 4.41 |
| B5-4-900 | 12.5 | 4.0 | 8.37 | 2.09 | 0.52 | 184.27 | 9.88 |
| B7-4-900 | 12.5 | 4.0 | 6.77 | 1.69 | 0.48 | 108.00 | 7.24 |
| B8-4-900 | 12.5 | 4.0 | 8.93 | 2.23 | 0.54 | 418.65 | 17.08 |
| Cnt-7-1000 | 0 | 4.0 | 17.57 | 4.39 | 0.99 | 165.33 | 14.76 |
| B5-7-1000 | 20 | 4.0 | 10.01 | 2.50 | 0.68 | 275.25 | 28.10 |
| B7-7-1000 | 20 | 4.0 | 6.81 | 1.70 | 0.49 | 59.83 | 6.04 |
| B8-7-1000 | 20 | 4.0 | 9.33 | 2.33 | 0.49 | 321.45 | 24.20 |

The invention claimed is:

1. A fiber comprising a mixture of at least two thermoplastic polymers each having different viscosities and wherein the mixture has an interfacial tension from 0.5 to 20 mN/m, wherein the mixture comprises a portion of the fiber surface, wherein the fiber is a bicomponent fiber of the sheath-core form and where at least one of the thermoplastic polymers is a polyolefin continuous phase, and at least one of the polymers in the mixture is a dispersed polymer in particulate form wherein the dispersed polymer has an average size larger than 1 micron, and wherein the sheath has a thickness smaller than the average size of the particulates of dispersed polymer.

2. The fiber of claim 1 wherein the ratio of the viscosity of the first thermoplastic polymer to the viscosity of the second thermoplastic polymer is from 1.5 up to 10, or from 0.1 down to 0.05.

3. The fiber of claim 1 wherein the sheath comprises less than 20 percent by volume.

4. The fiber of claim 1 wherein the core comprises a propylene polymer.

5. The fiber of claim 4 wherein the core comprises homopolymer propylene polymer.

6. The fiber of claim 1 wherein the matrix polymer has a melting point at least 10° C. or less than a melting point of the dispersed polymer.

7. The fiber of claim 1 wherein the matrix polymer has a melting point and the dispersed polymer is amorphous and has a glass transition temperature ≦10° C. than the melting point of the matrix polymer.

8. The fiber of claim 1 wherein the matrix polymer in the sheath and the material which comprises the core each have viscosity within about 30 percent from each other.

9. The fiber of claim 1 wherein the mixture has a viscosity 170 Pa·s at 100 l/s at 250° C.

10. The fiber of claim 1 wherein the dispersed particulate forms irregularities on the fiber surface.

* * * * *